United States Patent [19]

Desai

[11] Patent Number: 4,664,163

[45] Date of Patent: May 12, 1987

[54] METERING DISPENSING SYSTEM

[75] Inventor: Kirit C. Desai, Perrysburg, Ohio

[73] Assignee: Owens-Illinois, Inc., Toledo, Ohio

[21] Appl. No.: 824,824

[22] Filed: Jan. 31, 1986

[51] Int. Cl.[4] ..... B65B 3/04

[52] U.S. Cl. ..... 141/320; 215/313

[58] Field of Search ..... 215/313, 311, 312, 314, 215/315; 141/320, 321, 319

[56] References Cited

U.S. PATENT DOCUMENTS 1,970,451 8/1934 Gottlieb ..... 141/321

*Primary Examiner*—Houston S. Bell, Jr.
*Attorney, Agent, or Firm*—John R. Nelson

[57] ABSTRACT

A system for metering and dispensing product from a container is illustrated in an embodiment in which a closure, for a container having a neck portion, has a discharge port with a spout pivotally supported in the port. The spout has a top wall which closes the port and has spaced opposed depending side walls which extend into the container when the spout is in the closed position. The side walls have matching curvilinear edges. A valve member is supported in the container so that the spout can be moved into and out of registration with it. The valve member has a curvilinear surface that conforms to and mates with the curvilinear edges of the side walls when they are in registration to define a closed dispensing chamber having a predetermined measure of product therein. The spout is filled when out our registration with the valve member.

19 Claims, 24 Drawing Figures

METERING DISPENSING SYSTEM

BACKGROUND OF THE INVENTION

1. Field of the Invention

This invention relates generally to closure systems for containers and, more particularly, to systems which can dispense a metered amount of material or product from a container, and which can be substituted for the non-dispensing closure normally used with the container if sold as a separate product.

2. Description of the Prior Art

Dispensers for a measured amount of granular or particulate materials such as sugar, coffee, tea and the like are old and well known. It is also known to be old in the art to provide a measuring dispenser which is attachable to the neck of a jar or container in which the dispensing means is cooperatively mounted on and carried by a screw-on cap such as is used on the neck of a jar.

Many of these devices include a cylindrical body having one end threaded for connection to the mouth of a standard size jar or container so as to be readily attachable to the container holding the product to be ejected. However, such previously known dispenser cap devices are typically of complicated constructions having many working parts and are expensive to produce and assemble. Such devices are disclosed in U.S. Pat. Nos. 2,904,230, 3,129,853, and 3,327,905.

Other devices have attempted to simplify the construction of the metering dispenser system by incorporating a metering spout for discharging a predetermined amount of material. Examples of this dispenser are disclosed in U.S. Pat. Nos. 3,921,862 and 3,985,274. However, in simplifying the construction the precision in metering a desired amount has deteriorated, even though they do have the advantage of using a flow directing spout to discharge materials.

A dispenser cap disclosed in U.S. Pat. No. 4,429,815 simplifies the construction of the dispensing system, but lacks means for directing the flow of the discharged materials.

SUMMARY OF THE INVENTION

The present invention provides an improved metering system for dispensing product from a container which utilizes a spout having a top wall and spaced opposing side walls depending therefrom, the side walls having matching curvilinear edges. A valve member has a curvilinear surface shaped to conform to and mate with the curvilinear edges of the side walls of the spout. A supplemental wall means is adapted to cooperate with the side walls of the spout and the curvilinear surface of the valve member to define a measuring and dispensing chamber when all three are in registration with each other.

Means are provided for supporting the spout, valve member and supplemental wall means in an opening of a container. The support means further includes means for moving the three out of registration with each other to enable filling of the spout with product from the container, and for moving the three into registration with each other to confine a measured amount of product for dispensing.

The supplemental wall means in one instance is formed by a back wall of the spout which connects the depending side walls thereof. In another instance the supplemental wall means is connected to the valve means and extends vertically to close the back opening of the spout between the side walls thereof when the valve member and spout are in registration with each other.

The support means for the spout may include a cover or closure for an opening in the container, and may have a discharge port formed therein for receiving the spout. Means are provided for pivotally supporting the spout in the discharge port so that the side walls are within the container when the top wall closes the discharge port. The cover or closure may be attachable to and rotatable on a neck of a container to move the spout out of and into registration with the valve member.

The support means for the valve member may include means for securing the valve member against rotation in place in the container. For example, a plate may be used which extends across the opening of the container with the valve member depending therefrom. The support plate may have an opening formed therein above the valve member to receive the side walls of the spout. The opening is large enough to permit relative movement of the spout and valve member to obtain out of registration and in registration positions of the side walls of the spout and the curvilinear surface of the valve member.

As an alternative, a well may be formed in and depend from the valve member support plate. The well has a first upper opening to receive the side walls of the spout. One wall of the well is shaped to provide the curvilinear surface and act as the valve member. The well has a second opening formed in the curvilinear wall to provide an inlet port for filling the spout with product from the container.

It is an object of this invention to provide an improved metering dispensing system which is more simple, less expensive and has an improved operation.

Other objects, advantages and features of this invention will become more apparent during the course of the following description when it is read in conjunction with the accompanying drawings.

BRIEF DESCRIPTION OF THE DRAWINGS

In the drawings, where like numerals are employed to designate like parts throughout.

DESCRIPTION OF THE PREFERRED EMBODIMENTS

Figure 1:
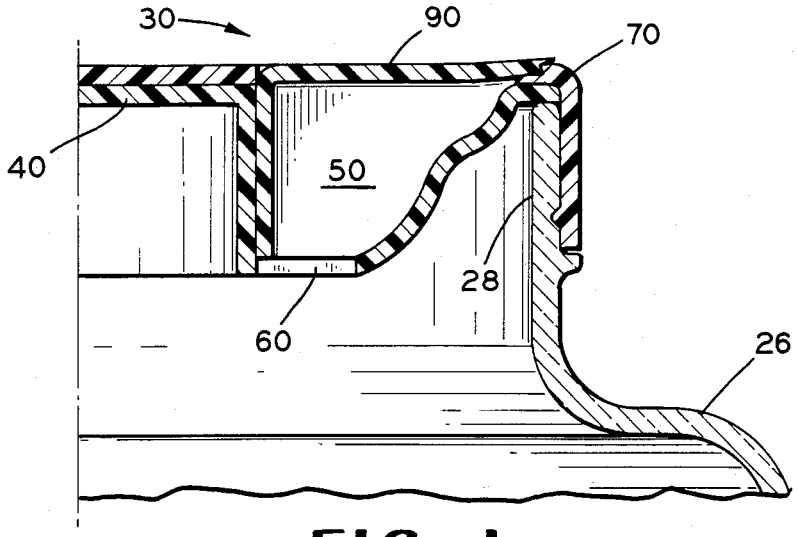
FIG. 1 is a cross-sectional view of a metering dispensing system embodying the teachings of this invention assembled in operating position on a container.
Figure 2:
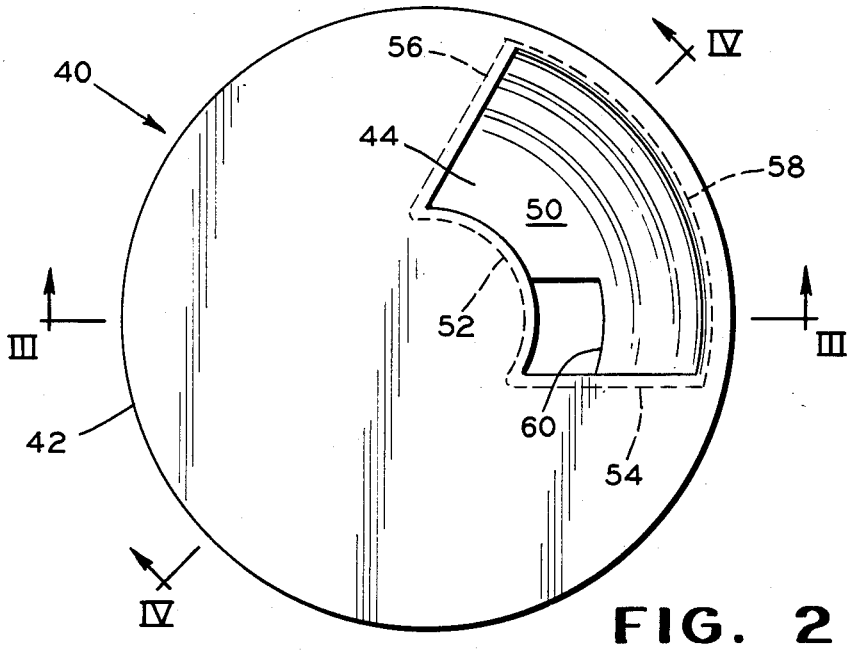
FIG. 2 is a plan view of the inner component of the system illustrated in FIG. 1.
Figure 3:
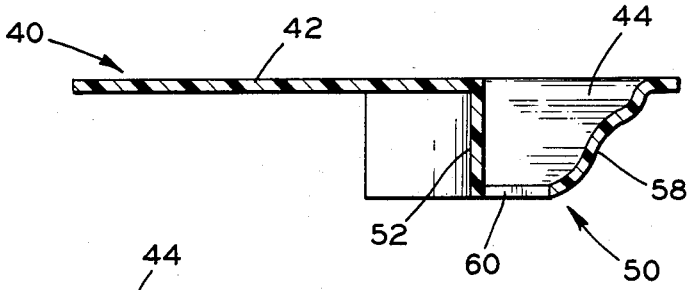
FIG. 3 is a cross-sectional view of the inner component illustrated in FIG. 2, taken along lines III—III of FIG. 2.
Figure 4:
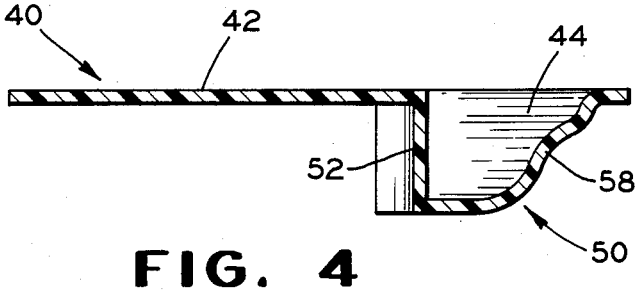
FIG. 4 is a cross-sectional view of the inner component illustrated in FIG. 2, taken along lines IV—IV of FIG. 2.
Figure 5:
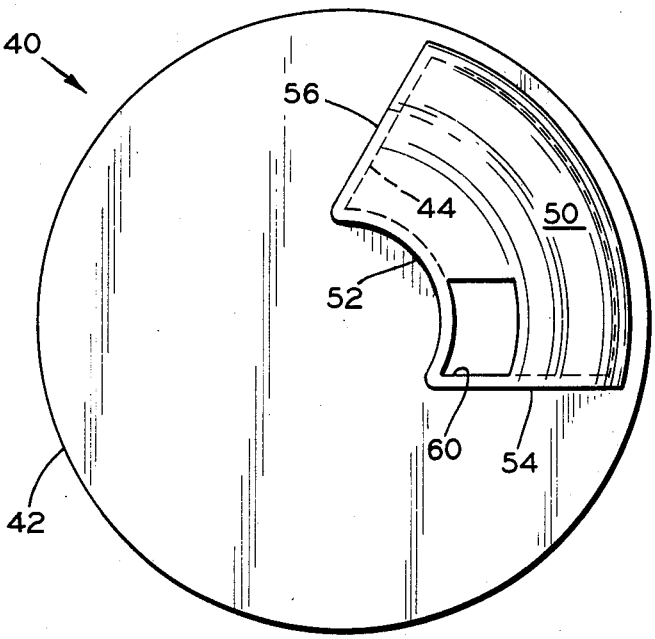
FIG. 5 is a bottom view of the inner component illustrated in FIG. 2.

Referring now to FIGS. 1 through 11 there is illustrated a first embodiment of a metering dispenser system that utilizes the teachings of this invention. FIG. 1 is a cross-sectional view of a system indicated generally at 30 which is assembled in operable position on the neck 28 of a jar or container 26.

The system includes an inner component 40 which is best seen in plan, first cross-sectional, second cross-sectional, and bottom views in FIGS. 2 through 5. The inner component 40 has a disk-shaped plate 42 formed to cover the opening defined by neck 28 of the container 26. A valving well 50 depends from plate 42 around an opening 44 formed in the plate and into the opening defined by neck 28, and thus will be disposed within the container 28 when the system 30 is assembled on the container.

The valving well 50 includes an inner substantially vertical arcuate side wall 52, two substantially vertical end walls 54 and 56, and an outer curvilinear wall 58 which defines both a side and a bottom wall. Wall 58 acts as a valve member to cooperate with the spout. A valve inlet port 60 is formed in wall 58 adjacent the intersection of end wall 54 and inner side wall 52.

Figure 9:
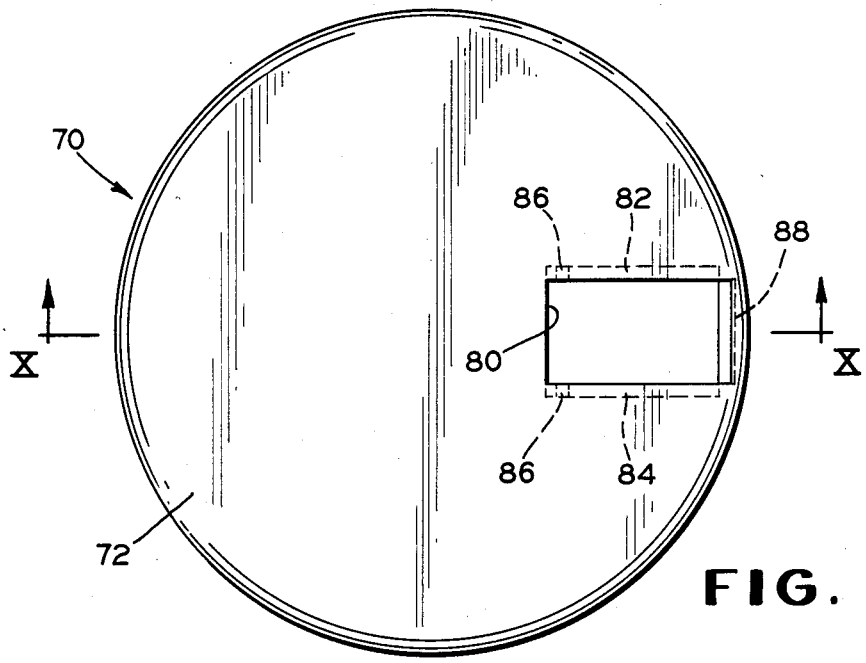
FIG. 9 is a plan view of the outer component of the system illustrated in FIG. 1.
Figure 10:
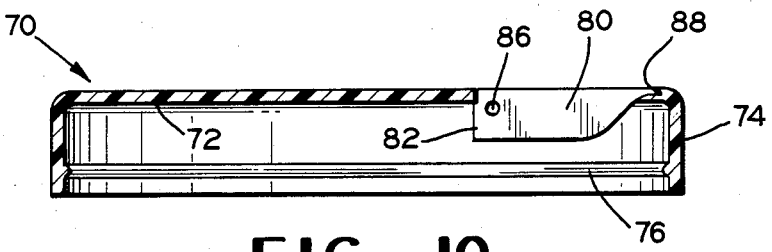
FIG. 10 is a cross-sectional view of the outer component illustrated in FIG. 9, taken along lines X—X of FIG. 9.

An outer component or cover 70 is best seen in plan and cross-sectional views in FIGS. 9 and 10. It includes a disk-shaped top or panel 72 with a downwardly depending skirt or cylindrical side wall 74. An inwardly projecting bead or detent 76 is formed on and extends circumferentially around the inside wall of skirt 74. The wall 74 is flexible enough to permit the cover 70 to be slipped over the neck 28 so that the bead or detent 76 can be received in a groove 78 formed in and extending circumferentially around the outer surface of the neck in a snap fit relationship. The bead/groove combination retains the cover 70 in place as shown in FIG. 1, while permitting rotation of cover 70 with respect to the neck 28 and inner component 40.

In the embodiment illustrated in FIG. 1, inner component 40 is held in place against rotation with respect to neck 28 by an adhesive. If the container 26 is formed from a plastic material, the component 40 may be welded to the container rather than using an adhesive.

Cover 70 further includes a discharge port 80 formed in the disk 72. Discharge port side walls 82 and 84 depend from port 80 and have opposed pivot holes 86 formed therein. The side walls stiffen the cover 70 in the vicinity of port 80 and act as guides for a spout means 90.

Figure 6:
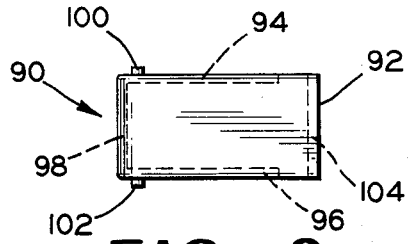
FIGS. 6, 7 and 8 are plan, side elevational and front views of a spout component used in the system illustrated in FIG. 1.
Figure 7:
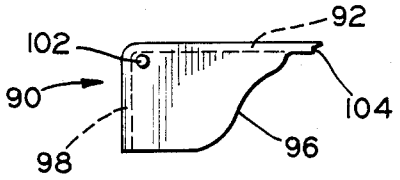
Figure 8:
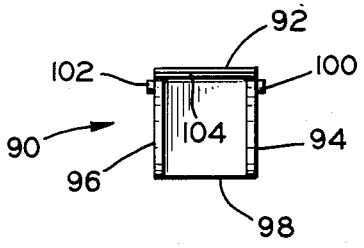

Referring now to FIGS. 6, 7 and 8 there is illustrated in plan, side elevational and front views a metering and discharge spout component 90. The spout 90 includes a top wall 92, depending side walls 94 and 96, a depending rear wall 98, and opposed pivot pegs 100 and 102. Opposed pivot holes 86 formed in the side walls 82, 84, or in the top panel or disk 72 of cover 70 adjacent the discharge port 80 thereof, receive pivot pegs 100, 102 to support the spout in the discharge port for pivotable movement between "open" and "closed" positions.

The top wall 92 of the spout 90 has a flexible snap fit edge 104 formed on the forward portions. A detent groove 88 is formed in the outermost wall of discharge port 80 to receive and hold the snap edge 104 of the spout 90, to retain the spout in a closed position. The spout 90 can be pivoted to an open position by disengaging the snap edge 104 from the detent groove 88 with a fingernail or other tool.

To assemble the components into a functional combination the inner component 40 is secured in place on the opening of a container as illustrated in FIG. 1. The spout component 90 is inserted into the discharge port 80 of the cover 70, with opposing pegs 100, 102 being snapped into opposing pivot holes 86. The cover/spout combination 70, 90 is then positioned above the inner component 40 so that the spout 90 registers with and can be received by the valving well 50 as the cover/spout combination is lowered onto the inner component/container combination. The curvilinear lower edges of the side walls 94, 96 of spout 190 conform to the curvilinear contour of the side/bottom wall 58 of the valving well 50.

Figure 11:
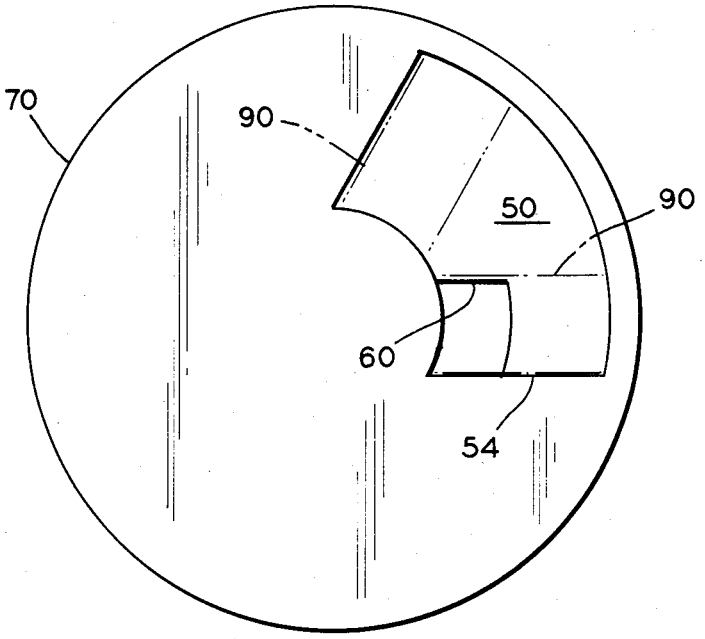
FIG. 11 is a plan view of the inner component of FIG. 2 with the spout shown in phantom lines in two different operating positions.

In operation, as best shown schematically in FIG. 11, the cover 70 is rotated clockwise until stopped by the end wall 54. This denotes a spout filling position, with the open bottom of the spout 90 registering with the inlet valve port 60. The container 26 is turned upside down permitting product from the container 26 to fill the inner volume of the spout. While the container 26 is still inverted the cover 70 is rotated in a counter clockwise direction until the spout no longer registers with the inlet port 60. The container is then reinverted to an upright position. The measured or metered amount of product retained inside the spout 90 can then be dispensed by tipping the container 26 and pivoting the spout 90 to the open position.

Figure 12:
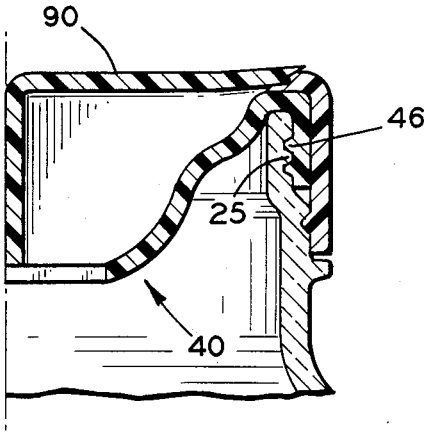
FIG. 12 is a cross-sectional view of a second embodiment of the inner component of FIG. 2 illustrating a threaded connection of the inner component to a container neck.

FIG. 12 is a cross-sectional view of a metering dispenser system illustrating a second embodiment of an inner component 40 which is attached to container 26 by screw threads 46 formed on the internal surface of a downwardly depending skirt 47 which is added to disk plate 42. The skirt threads 46 cooperate with threads 25 formed on the outer surface of neck 28 to securely hold the inner component 40 in the desired position.

Figure 13:
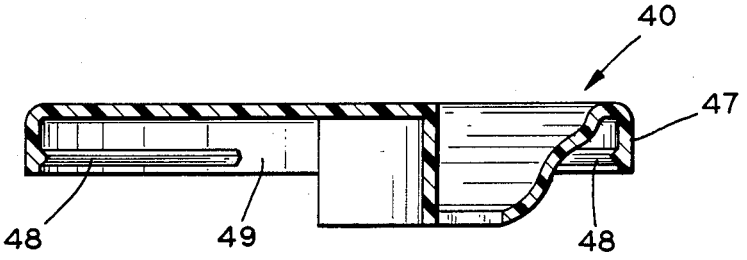
FIG. 13 is a cross-sectional view of a third embodiment of the inner component of FIG. 2 illustrating a snap fit connection of the inner component for the neck of a container.

FIG. 13 is a cross-sectional view of an inner component which illustrates a third embodiment of the component 40. The downwardly dependent skirt 47 has a bead 48 formed on the inner surface thereof which cooperates with a groove formed in the outer surface of the container neck, permitting a snap fit arrangement which will retain component 40 on neck 28. The bead 48 may be interrupted as shown at 49, so that if a matching interruption is provided in the neck groove then rotation of the inner component 40 with respect to neck 28 and outer cover 70 is prevented.

Figure 14:
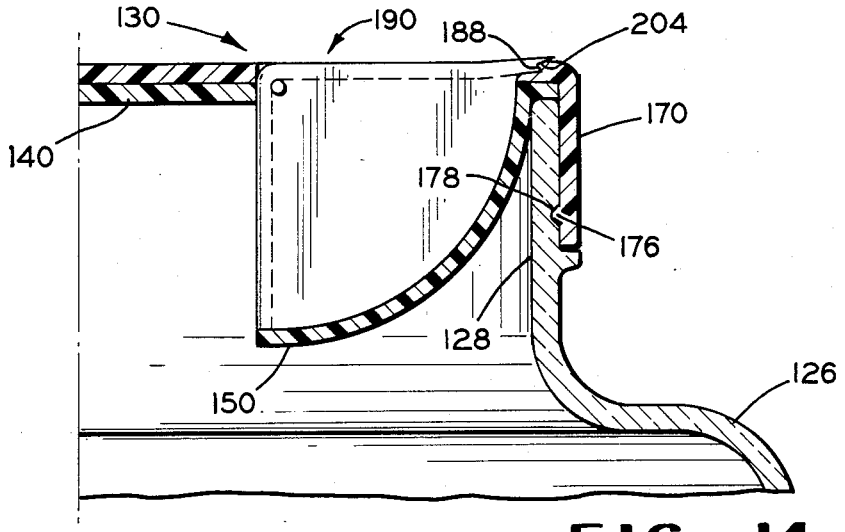
FIG. 14 is a cross-sectional view of a second embodiment of a metering dispensing system of this invention assembled in operating position on a container.

Referring now to FIGS. 14 through 22 there is illustrated a second embodiment of a metering dispensing system utilizing the teachings of this invention. FIG. 14 is a cross-sectional view of a system indicated generally at 130 which is assembled in operable position on the neck 128 of a jar or container 126.

Figure 15:
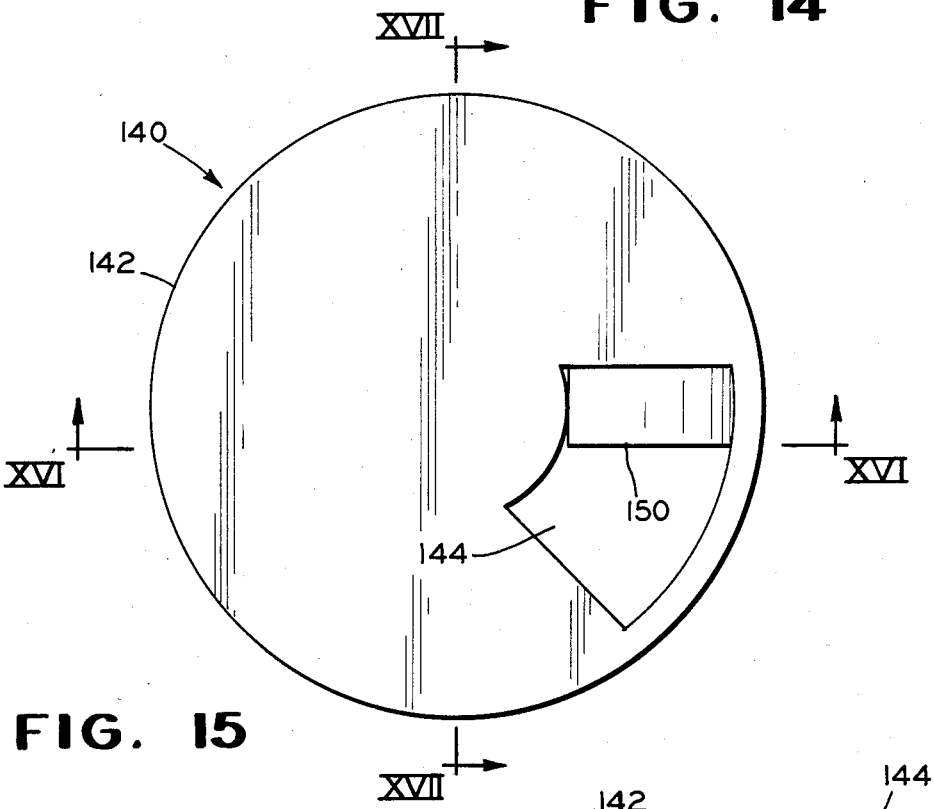
FIG. 15 is a plan view of the inner component of the system illustrated in FIG. 14.
Figure 16:
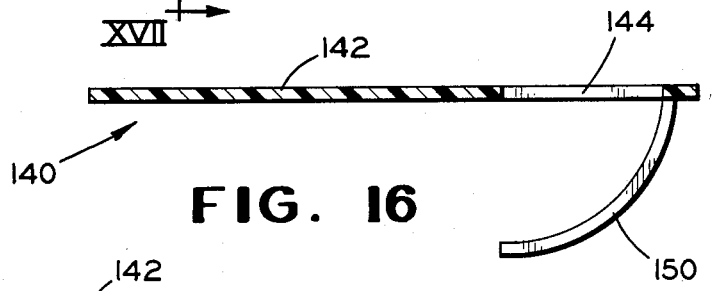
FIG. 16 is a cross-sectional view of the inner component of FIG. 15, taken along lines XVI—XVI of FIG. 15.
Figure 17:
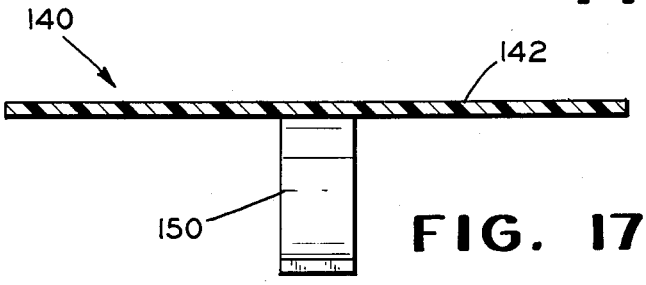
FIG. 17 is a cross-sectional view of the inner component of FIG. 15, taken along lines XVII—XVII of FIG. 15.

The system includes an inner component 140, which is best seen in plan, first cross-sectional and second cross-sectional views in FIGS. 15, 16 and 17. The inner component has a disk-shaped plate 142 formed to cover the opening defined by neck 128 of the container 126. A valve member 150 depends from and is supported in the interior of the container 126 by the plate 142. The valve member is located beneath an opening 144 formed in plate 142. The opening has end walls 144, 146 that function as stops or position locaters for the spout component to be described hereinafter.

Figure 18:
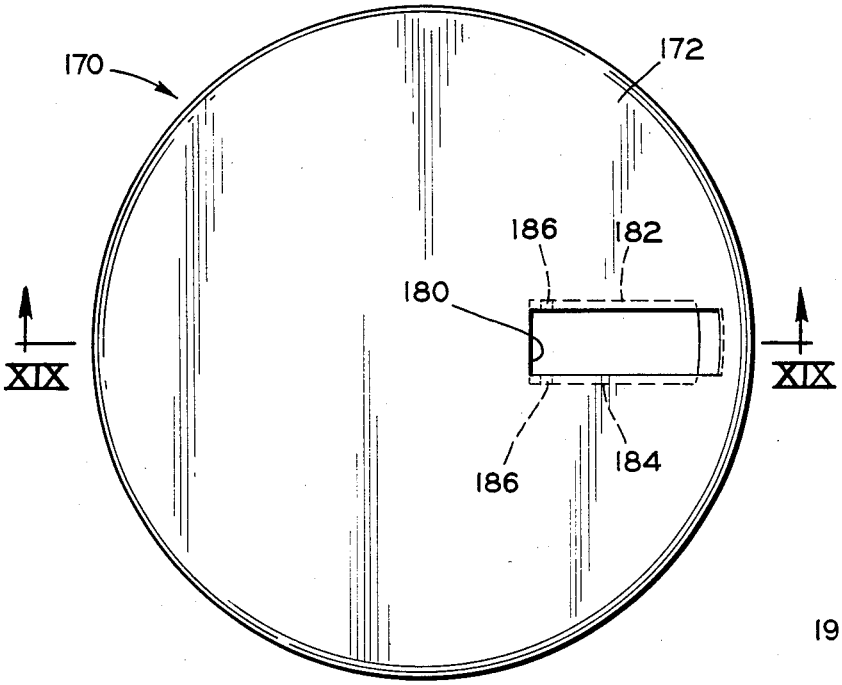
FIG. 18 is a plan view of an outer component of the system illustrated in FIG. 14.
Figure 19:
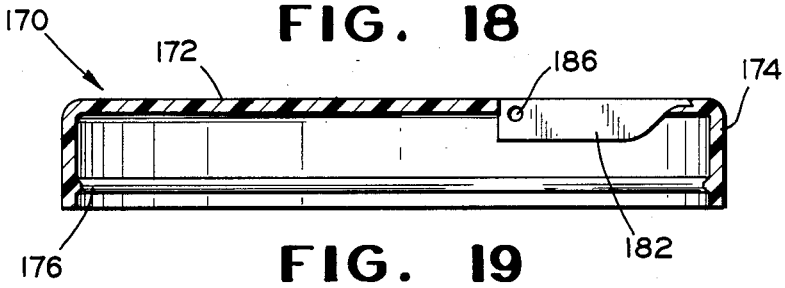
FIG. 19 is a cross-sectional view of the outer component illustrated in FIG. 18, taken along lines XIX—XIX of FIG. 18.

An outer component or cover 170 is best seen in plan and cross-sectional views in FIGS. 18 and 19. The cover 70 includes a disk shaped top panel 172 with a downwardly depending skirt or cylindrical side wall 174. An inwardly projecting bead or detent 176 is formed on and extends circumferentially around the inside wall of skirt 174. The wall 174 is flexible enough to permit the cover 170 to be slipped over the neck 128 so that the bead or detent can be received in a groove 178 formed in and extending circumferentially around the outer surface of neck 128, as shown in FIG. 14, in a snap fit relationship. The bead/groove combination retains the cover 170 in place on neck 128, while permitting rotation of cover 170 relative to the neck 128 and inner component 140 and its supported valve member 150.

It is possible to utilize the bead 176/groove 178 structure as a stop or position locater for the spout to be described hereinafter. That is, if the groove and bead are interrupted at selected points around the outer surface of the neck 128 and inner surface of skirt 174, and if the length of the groove is longer than the length of the bead received thereby, then the cover 170 can be rotated for the distance the length of the groove exceeds the length of the bead.

In the embodiment illustrated in FIG. 14, inner component 140 may be held in place against rotation with respect to neck 128 by an adhesive. Alternatively, the component 140 may be welded to neck 128, have screw threads on an attached outer skirt, or have a bead/-groove retention structure to hold it in place in a desired position on neck 128 as described hereinbefore.

Cover 170 further includes a discharge port 180 formed in the disk 172. Side walls 182, 184 depend from the edges of port 180 and have opposed pivot holes 186 formed therein. The side walls stiffen the plate or disk 172 in the vicinity of port 180 and act as guides for a spout component.

Figure 20:
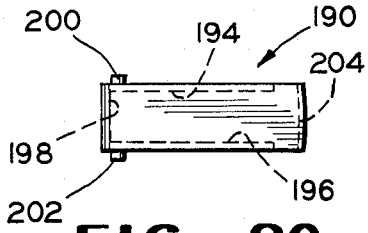
FIGS. 20, 21 and 22 are plan, side elevational and front views of the spout component of the system illustrated in FIG. 14.
Figure 21:
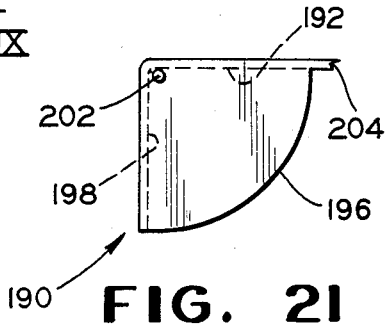
Figure 22:
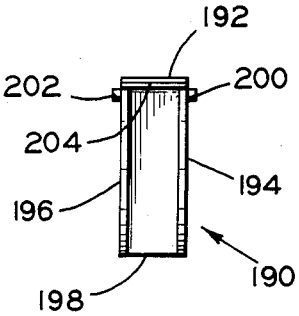

Referring now to FIGS. 20, 21 and 22 there is illustrated in plan, side elevational and front views a metering and discharge spout component 190. The spout 190 includes a top wall 192, depending side walls 194 and 196, a depending rear wall 198, and opposed pivot pins 200, 202. Opposed pivot holes 186 formed in the side walls 182, 184, or in the top panel or disk 172 of cover 70 adjacent the discharge port 180 thereof, receive pivot pins 200, 202 to support the spout 190. The spout 190 is mounted for rotation between "open" and "closed positions".

The top wall 192 of the spout 190 has a flexible snap fit edge 204 formed on the forward portion thereof. A detent groove 188 is formed in the outermost wall of the discharge port 180 to receive and hold the snap edge 204 of the spout 190, to retain the spout in a closed position. The spout 190 can be pivoted to an open position by disengaging the snap edge 204 from the detent groove 188 with a fingernail.

To assemble the components into a functional combination the inner component 140 is secured in place on the neck of a container as illustrated in FIG. 14. The spout component 190 is inserted into the discharge port 180 of the cover 170, with opposing pins 200, 202 being snapped into opposing pivot holes 186. The cover/spout combination 170, 190 is then positioned above the inner component 140 so that the spout 190 registers with and can be received by the opening 144 formed in inner component 140 as the cover/spout combination is lowered onto the inner component/container combination.

The curvilinear lower edges of the side walls 194, 196 of spout 190 conform to and mate with the curvilinear surface or contour of the valve plate or member 150, thus permitting the spout 190 to be rotated into position above valve plate 150 and to define in combination therewith a closed chamber having a predetermined volume.

In this embodiment the lower edges of walls 194, 196 describe arcs of a circle having a constant radius throughout the arc. Similarly, the contour of the innermost surface of the wall of valve plate 150 follows arcs of the same dimensions as those of the lower edges of walls 194, 196. This permits a very, very close fit between side walls 194, 196 and valve plate 150. In fact, if the leading edges of walls 194, and 196 are beveled, and the radius of the arc of walls 194, 196 is made slightly larger than the radius of the arcs defined by the contour of valve plate 150, a wiping and sealing action will occur when spout 190 is rotated into position above valve plate 150. This, then, results in a sealed chamber suitable for dispensing very, very fine powders and liquids.

In operation, the cover 170 is rotated clockwise until the spout 190 is stopped by the end wall or edge of opening 144. As noted hereinbefore, the bead 176, groove 178 structure may also be used as a stop or position locater for the spout 190. This is the spout filling position, with the bottom of the spout being open to the interior of the container 126. Turning the container 126 to an inverted position fills the spout 190 with product from the container.

While the container is inverted the cover 170 is rotated in a counter clockwise direction until the spout 190 reaches a stop position in registration with valve plate 150. The stop position may be defined by an end wall of the opening 144 formed in the plate 142 of inner component 140, or by a cover bead/neck groove structure described hereinbefore. As the filled spout 190 is rotated into registration with valve plate 150, excess product is scraped off the amount in the spout so that when full registration is achieved a metered amount is in the now closed chamber ready for dispensing when the spout is pivoted to an open position.

Figure 23:
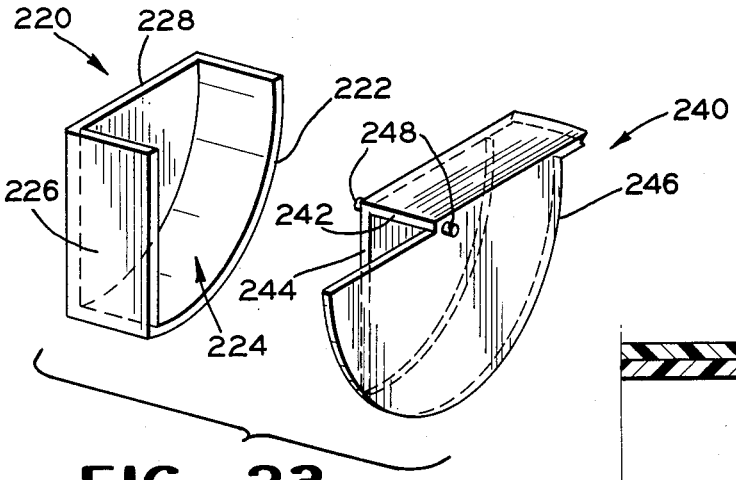
FIG. 23 is an exploded view of a second embodiment of the spout component of FIGS. 20, 21 and 22 along with a second embodiment of a portion of the inner component of FIGS. 15, 16 and 17.

Referring now to FIG. 23 there is shown an exploded view of a valve member and spout component which illustrate further embodiments of the teachings of this invention.

The valve member is illustrated generally at 220 and includes a wall 222 which has a curvilinear surface 224 for registering with curvilinear lower edges of side walls of a spout component to form an enclosed metering and dispensing chamber as discussed hereinbefore. The valve member is adapted to be supported within the container by connection to a disk across the neck opening, by welding or adhering to the interior surface of the neck of the container, or other suitable means.

If the valve member is to be attached to a plate across the neck opening, then a vertical wall 226 may be secured at its lower end to the end of the valve wall 222, and at its upper end to a support plate. Similarly, an end wall 228 may connect the edge of the valve wall 222 and the edge of the vertical wall 226 to the support plate.

The spout component portion of FIG. 23 is indicated generally at 240. It includes a top wall 242, depending side walls 244, 246 and opposed pivot pins 248.

If the spout component 240 and valve member 228 are used as illustrated, then no rear wall need be provided for the spout component. That is, the side wall 228 of valve member 220 will retain the metered amount of product in place on the valve member surface 224 on one side as the spout component is pivoted from a closed to an open position. Similarly, the side wall 246 will also retain the metered amount of product in place on the valve member surface 224 since the surface area has been extended from a quarter circle or sector to half circle or sector. Therefore, the rear quarter circle or sector will keep that side of the valve member closed, even though the spout is in the fully open position.

The advantage to this combination lies in the fact that the spout can be fully opened without the metered amount of product being urged out of a discharge port by a rear wall of a spout. Therefore, the spout can be fully opened while the container is upright. Then the open spout can be positioned precisely at or over a desired discharge area or point, and the container then tilted to directionally discharge the product lying on surface 224, allowing better dispensing control.

Figure 24:
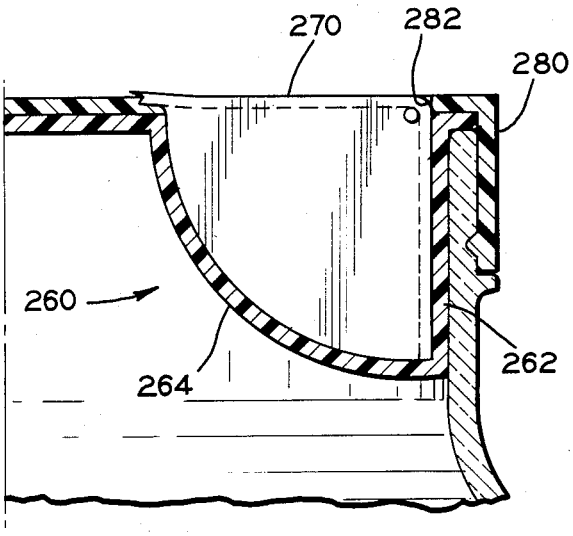
FIG. 24 is a cross-sectional view of a third embodiment of a metering dispensing system of this invention assembled in operating position on a container.

Referring now to FIG. 24 there is illustrated a cross-sectional view of a third embodiment of a metering dispensing system illustrating the teachings of this invention. A valve member 260 has its position reversed in this embodiment so that the curvilinear surface thereof faces toward the neck of the container, rather than toward the center of the opening as in previous embodiments.

The outer vertical support wall 262 of the valve member may be omitted unless it is needed to support the curvilinear wall 264.

Similarly, the position of a spout component 270 has been reversed in a discharge port 282 of a cover component 280. Therefore, when the spout component is opened the container can be tilted in a more natural direction and the discharge from the spout more directionally controlled. Further, this embodiment permits almost all of the product in a container to be dispensed in metered amounts.

It is apparent from the above description of the various embodiments that some of the parts have the same function and therefore can be classified generically. For example, the function of the back wall 198 of the spout shown in FIG. 21 is the same as that of the vertical wall support member 226 in FIG. 23. That is, both are supplemental wall means adapted to cooperate with the side walls of the spout and the curvilinear surface of the valve member to define a measuring and dispensing chamber.

It should also be noted that the invention involves relative movement of the spout with respect to the valve member. Therefore, although the spout is moved in the embodiments shown, it is within the scope of this invention to maintain the spout in one position while moving the valve member into and out of registration with the spout. It is also possible to move both components to obtain out of registration and in registration positions.

The beads/groove structure shown can, or course, be reversed so that the bead is formed on the neck while the groove is formed in the inner surface of the closure or inner component skirt. This structure is a detent means with part of the structure on the neck to cooperate with a mating structure on the skirt, enabling a snap fit of the skirt on the neck.

It should be further noted that while the invention has illustrated and is particularly useful in embodiments utilizing closures for containers having necks defining an opening to the container, it is also useful when the system is installed as part of the wall of a container. That is, the spout and valve member may be moved into and out of registration with each other by structures that provide linear reciprocal motion rather than the rotary reciprocal motion shown.

Finally, as noted by the cross-hatching in the sectional views, the components are advantageously formed from plastic materials although other materials may be used in specific embodiments.

It is to be understood that the forms of the invention herewith shown and described are to be taken as illustrative embodiments only, and that various changes in the size, shape and arrangement of the parts may be made without departing from the spirit and scope of the invention.

I claim:

1. A metering system for dispensing product from an opening in a container, comprising:

(a) a spout means having a top wall and spaced opposing side walls depending therefrom, said side walls having matching curvilinear edges, (b) a valve member having a curvilinear surface shaped to conform to said curvilinear edges of said side walls of said spout means.

(c) supplemental wall means adapted to cooperate with said side walls of said spout means and said curvilinear surface of said valve member to define a measuring chamber when all are in registration with each other, and (d) means for supporting said spout means, valve member and supplemental wall means in an opening of a container, for moving them out of registration with each other to enable filling of said spout means with product from the container, and for moving them into registration with each other to confine a measured amount of product for dispensing.

2. A metering system as defined in claim 1 in which said supplemental wall means is a back wall of said spout means which connects the depending side walls thereof.

3. A metering system as defined in claim 1 in which said supplemental wall means is connected to said valve member and which closes a back opening of said spout means between said side walls thereof when said valve member and spout means are in registration with each other.

4. A metering system as defined in claim 1 in which said support means for said spout means includes a cover means for an opening in a container, said cover means having a discharge port formed therein for receiving said spout means.

5. A metering system as defined in claim 4 which further includes means for pivotally supporting said spout means in said discharge port so that the side wall means thereof are within a container when the top wall closes the discharge port.

6. A metering system as defined in claim 5 in which said cover means is adapted to be attachable to and rotatable on a container to move said spout means out of and into registration with said valve member.

7. A metering system as defined in claim 1 in which said support means for said valve member includes means for securing said valve member against rotation in place in a container.

8. A metering system as defined in claim 1 in which said support means for said valve member includes a plate extending across an opening of a container with the valve member depending therefrom.

9. A metering system as defined in claim 8 in which said valve member support plate has an opening formed therein above said valve member to receive the side walls of said spout means, said opening having an area sufficiently large enough to permit relative movement of said spout means with respect to said valve member to obtain out of registration and in registration positions of said spout means and the curvilinear surface of said valve member.

10. A metering system as defined in claim 8 which further includes a well means formed in and depending from said valve member support plate, the well means having a first opening for receiving the side walls of said spout means, one wall of said well means providing said curvilinear surface of said valve member which is shaped to conform to the curvilinear edges of the side walls of said spout means, said curvilinear wall of said well means having a second opening formed therein to provide an inlet port for filling said spout means from a container.

11. A metering system for dispensing product from a container having a neck portion defining an opening of the container, comprising:

(a) closure for and attachable to a neck of a container, said closure having a discharge port formed therein, (b) spout means pivotally mounted in said discharge port including a top wall adapted to close said discharge port and side walls depending from said top wall into said container when said spout means is closed, said side walls having matching curvilinear edges.

(c) a valve means having a curvilinear surface shaped to conform to and receive said curvilinear edges of said side walls of said spout means, (d) means for supporting said valve means in a neck of a container, (e) one of said spout means and valve means having supplemental wall means which cooperates with said side walls of said spout means and said curvilinear surface of said valve means to define a measuring chamber when spout and valve means are in registration with each other, and (f) means enabling movement of said spout means and valve means with respect to each other to obtain an out of registration position for said spout means to permit filling of said spout means with product from said container, and to obtain an in registration position to confine a measured amount of product between said curvilinear surface, side walls of said spout means and said supplemental wall means.

12. A metering system as defined in claim 11 in which said support means for said valve means includes a plate member applicable to a neck of a container beneath said closure, said plate member having an opening formed therein to receive said side walls of said spout means and permit relative movement of said side walls and said valve means between out of registration and in registration positions.

13. A metering system as defined in claim 12 in which said valve means support plate further includes a downwardly depending skirt attached to the periphery thereof for engaging the neck of a container.

14. A metering system as defined in claim 13 in which said valve means support plate skirt has screw threads formed on the interior surface for attachment to a screw threaded neck.

15. A metering system as defined in claim 13 in which said valve means support plate skirt has detent means formed on the inner surface thereof adapted to cooperate with a mating detent means formed on the neck of a container, enabling said skirt to be applied to a neck with a snap fit connection.

16. A metering system as defined in claim 12 in which one of said closure and valve means support plate is securable to a neck of a container while the other is rotatable on a neck of a container to obtain said out of registration and in registration positions.

17. A metering system as defined in claim 16 in which said closure includes a top panel and a depending cylindrical skirt, said skirt having a detent means formed on the inner surface thereof adapted to cooperate with a mating detent means formed on a neck of a container enabling said skirt to be applied to a neck of a container with a snap fit connection.

18. A metering system as defined in claim 11 in which said supplemental wall means comprises a back wall on said spout means connecting the side walls thereof.

19. A metering system as defined in claim 11 in which said supplemental wall means is connected to said valve means and which closes a back opening of said spout means between said side walls thereof when said valve means and spout means are in registration with each other.

* * * * *